US005732487A

United States Patent [19]

Van De Kerckhove

[11] Patent Number: 5,732,487

[45] Date of Patent: Mar. 31, 1998

[54] DREDGE HEAD FOR DREDGING SLUDGE BY A TRAILING OR PUSHING MOTION

[75] Inventor: Théo Van De Kerckhove, Wilrijk, Belgium

[73] Assignee: Dredging International, Zwijndrecht, Belgium

[21] Appl. No.: 625,977

[22] Filed: Apr. 1, 1996

[30] Foreign Application Priority Data

Mar. 30, 1995 [BE] Belgium ..... 09500285

[51] Int. Cl.[6] ..... E02F 9/28

[52] U.S. Cl. ..... 37/333; 37/334; 37/409

[58] Field of Search ..... 37/333, 317, 334, 37/336, 408, 409, 410, 908; 172/815

[56] References Cited

U.S. PATENT DOCUMENTS

| | | | |
|---|---|---|---|
| 927,690 | 7/1909 | Singleton | 37/333 |
| 1,840,606 | 1/1932 | Scheffauer | 37/333 |
| 2,061,924 | 11/1936 | Slate | 37/408 |
| 3,462,963 | 8/1969 | Moore | 37/317 X |
| 3,521,386 | 7/1970 | Francklyn | 37/446 X |
| 3,748,760 | 7/1973 | Schnell | 37/318 |
| 3,988,843 | 11/1976 | Brockett, III | 37/317 X |
| 4,150,502 | 4/1979 | Sijthoff | 37/333 |
| 4,265,035 | 5/1981 | Goedvolk | 37/333 |

FOREIGN PATENT DOCUMENTS

| | | | |
|---|---|---|---|
| 2448308 | 4/1975 | Germany | 37/333 |
| 37041172 | 7/1937 | Netherlands | 37/317 |
| 7000732 | 7/1971 | Netherlands . | |
| 79002737 | 10/1980 | Netherlands | 37/333 |
| 8202185 | 12/1983 | Netherlands . | |
| 88000129 | 8/1989 | Netherlands | 37/317 |
| 164846 | 8/1964 | U.S.S.R. | 37/317 |
| 909035 | 2/1982 | U.S.S.R. | 37/317 |
| 355005 | 8/1931 | United Kingdom . | |
| WO89/00630 | 1/1989 | WIPO . | |

*Primary Examiner*—Randolph A. Reese
*Assistant Examiner*—Thomas A. Beach
*Attorney, Agent, or Firm*—Spencer & Frank

[57] ABSTRACT

A dredge head for dredging sludge by a trailing and pushing motion thereby defining a trailing and pushing direction is configured to be fitted on a ladder of a stationary dredger. The ladder is movable in the trailing and pushing direction for moving the dredge head. The dredge head includes: a component defining a passageway having a longitudinal axis in the trailing and pushing direction, the component being configured to be connected to a suction tube at a rear extremity thereof; a first scraper and a second scraper both disposed at a front extremity of the component and facing one another, the first scraper and the second scraper further having respective cutting edges extending transversely to the longitudinal axis of the passageway and defining an elongated opening therebetween, the first scraper being fixed with respect to the component and the second scraper being configured to have an adjustable height with respect to the first scraper; and a visor connected to the second scraper and being movable with respect to the component for effecting a height adjustment of the second scraper with respect to the first scraper.

6 Claims, 5 Drawing Sheets

DREDGE HEAD FOR DREDGING SLUDGE BY A TRAILING OR PUSHING MOTION

FIELD OF THE INVENTION

This invention relates to a dredge head for dredging sludge by a trailing and pushing motion from a stationary dredger equipped with a ladder which can be displaced to and fro, both to the left and to the right with respect to the transverse direction of the dredger.

SUMMARY OF THE INVENTION

An object of the invention is to achieve a dredge head which permits the removal of well determined layer thicknesses of dredgings, more particularly sludge, in an ecological way.

Dredging sludge in an "ecological way" means achieving its removal without creating turbidity or at least under circumstances which reduce this turbidity to a strict minimum. The invention is also indented to provide a dredge head design which permits the amount of water in the dredged to be kept at a low level, the above having an advantageous influence on the volume of material which has to be processed afterwards.

The invention has further also very concrete objectives which can be summarized as follows:

a) to dredge well determined and controlled thicknesses of dredgings;

b) to dredge in small water depths with a minimum depth of about 2 m;

c) to take measures for minimizing water intake and keeping the water suction under control;

d) to dredge accurately both in the horizontal plane and in the vertical plane.

In order to achieve these objectives in accordance with the invention, the dredge head according to the invention consists of a space, the longitudinal axis of which extends in the trailing or pushing direction, which space shows on one extremity dimensions which permit to connect the dredge head to a suction tube whilst the other extremity shows an elongated opening extending transversely with respect to said transverse axis and each of the transverse edges of which, directed towards one another, are equipped with scrapers, which are directed towards one another, and the cutting edges of which are parallel to the longitudinal axis of said elongated opening, the first of said scrapers being fixed with respect to the dredge head itself while the second scraper is adjustable in height, together with a visor, with respect to the first scraper.

Still according to the invention, said visor is formed by a rotatable cylindrically bent plate, the radius of which is somewhat smaller than the radius of a fixed cylindrically bent plate the visor cooperates with and which is a constituent part of the dredge head itself, which visor, to which said second scraper is connected, is provided with side plates to make from this portion of the suction head a space closed off laterally and at the top, and characterized further in that means are provided for rotating the visor and the second scraper connected thereto about a horizontal axis to modify the height of the second scraper with respect to the first scraper.

In order to move the second scraper always in its horizontal position, said visor is moved, together with the second scraper connected thereto, by a hydraulic jack, which is mounted on the dredge head, through the intermediary of a rotatable arm hingedly supported with respect to the dredge head, the up and downwards movable extremity of which is connected to a plate or to a set of two plates connecting this extremity to said second scraper in such a manner that the different hinge points formed or defined by the following components, said horizontal axis, the two hinge points of said rotatable arm and a hinge point between the visor and the second scraper coincide with the four corners of a deformable parallelogram.

BRIEF DESCRIPTION OF THE DRAWINGS

Other details and advantages of the invention will become apparent from the following description of a dredge head according to the invention. This description is given by way of example and does not limit the invention. The reference numerals relate to the figures annexed hereto, in which.

DETAILED DESCRIPTION OF THE INVENTION

Figure 1:
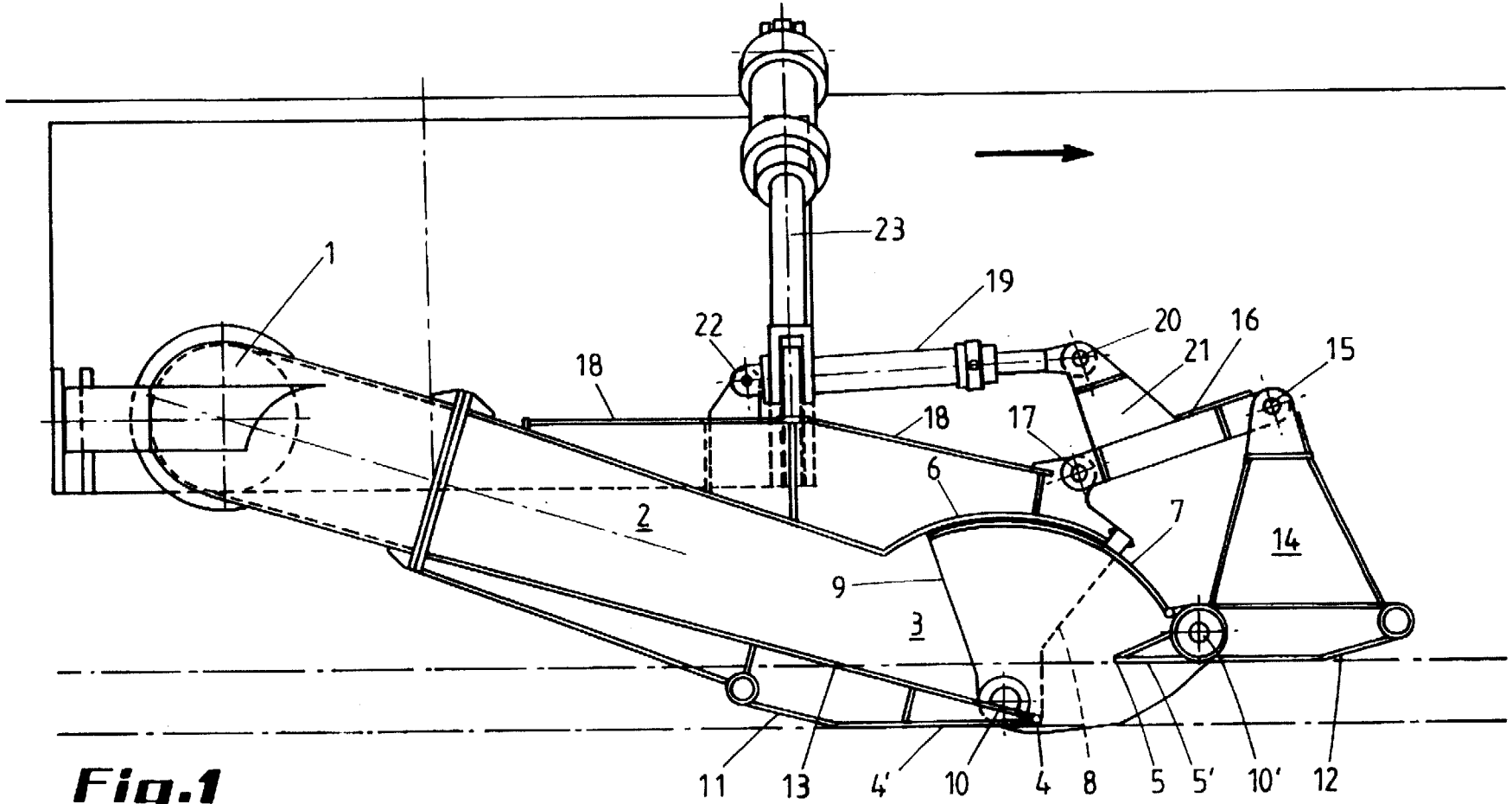
FIGS. 1 and 2 are schematic side elevational views of the dredge head according to the invention, the direction of dredging being indicated in each case by an arrow.

The dredge head shown in these figures is designed to be fitted on the extremity of a ladder with suction tube so that during each swinging motion of the ladder, one of the scrapers of the dredge head is operative.

The dredge head shows moreover a new and very original structure which offers the possibility to dredge well determined sludge layers which can be determined from the dredger.

The dredge head according to the invention defines a space or passageway having its largest width at the level of the materials to be dredged, which space has a conical shape to allow for connection to a suction tube 1.

The intended space is defined by conically shaped component 2. The space further includes an actual space 3, the volume of which is determined, at the bottom, by two scrapers which will be called hereinafter the first scraper 4 and the second scraper 5 and, at the top, by a cylindrically bent plate 6 and a rotatable visor 7 cooperating therewith.

Both scrapers 4 and 5 are extended at the bottom by levelling plates 4' and 5'.

Laterally, the actual space 3 of the dredge head is each time confined, on the one hand, by a plate 8 which is connected to and which is a constituent part of the conically shaped component 2 and, on the other hand, by a side plate 9 which is rigidly connected to the visor 7.

The visor 7 is in the first place rotatably mounted on a horizontal shaft 10. This shaft 10 is rotatable on a frame component 11 of the suction head to which the first scraper 4 and levelling plate 4' are fixed. The visor 7 is further hingedly connected to a second frame component 12 of the dredge head to which the second scraper 5 is fixedly mounted. The hinge connection between the visor 7 and the second frame component 12 is situated at 10'.

The second frame component with the second scraper 5 with levelling plate 5' is extended upwards by a set of two plates 14 which are hingedly connected at the top in 15 to a rotatable arm 16 which is itself hingedly connected at 17 with respect to a third frame component 18 of the dredge head.

Upward and downward movements of the rotatable arm 16 are controlled by a hydraulic jack 19. This hydraulic jack has two hinge points, i.e. a first 20 with respect to a knee plate 21 to which the rotatable arm 16 is fixed and a second 22 with respect to the hereinabove mentioned third frame component 18.

As the second frame component 12 can finally slightly rotate with respect to a horizontal axis 10_', together with the visor 7 which is hingedly connected thereto, a structure with hinge points 10, 10', 15, 17, in the shape of a deformable parallelogram is achieved.

Figure 3:
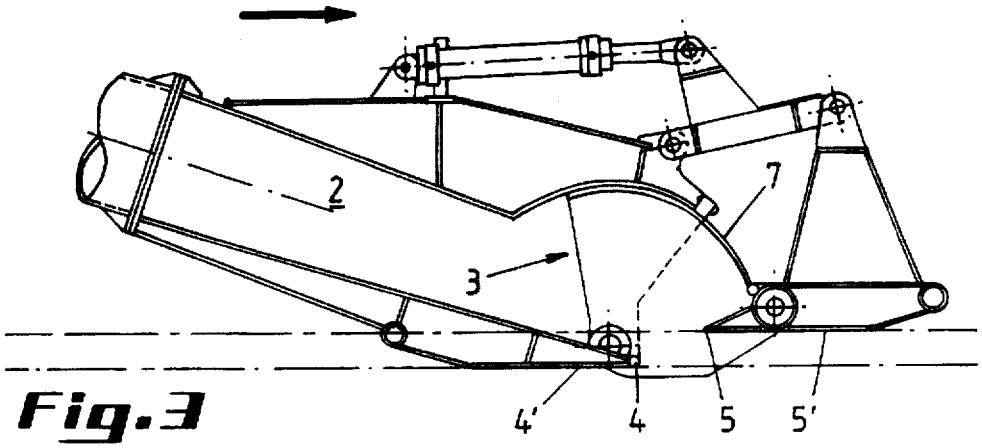
FIGS. 3 to 8 show also schematically and on a reduced scale each time three possible adjustable depths of the scrapers and this for three different depths, the direction of dredging being indicated in each stage by an arrow.
Figure 4:
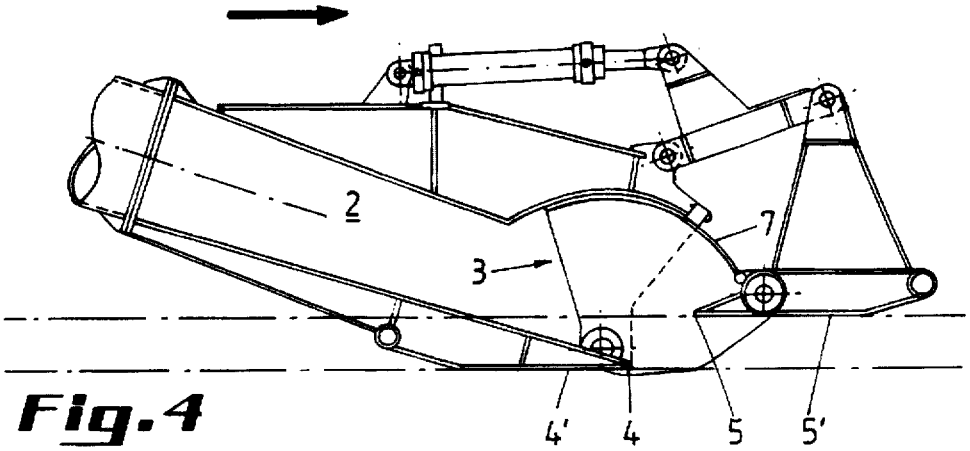
Figure 5:
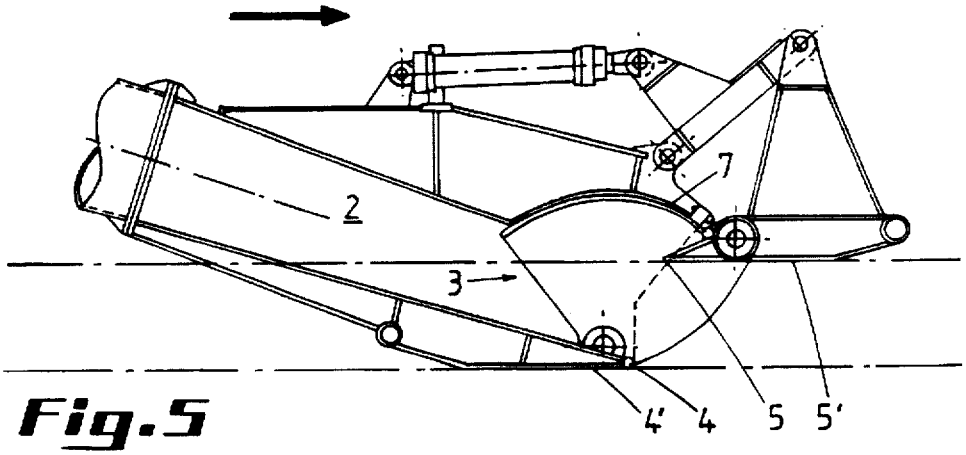
Figure 6:
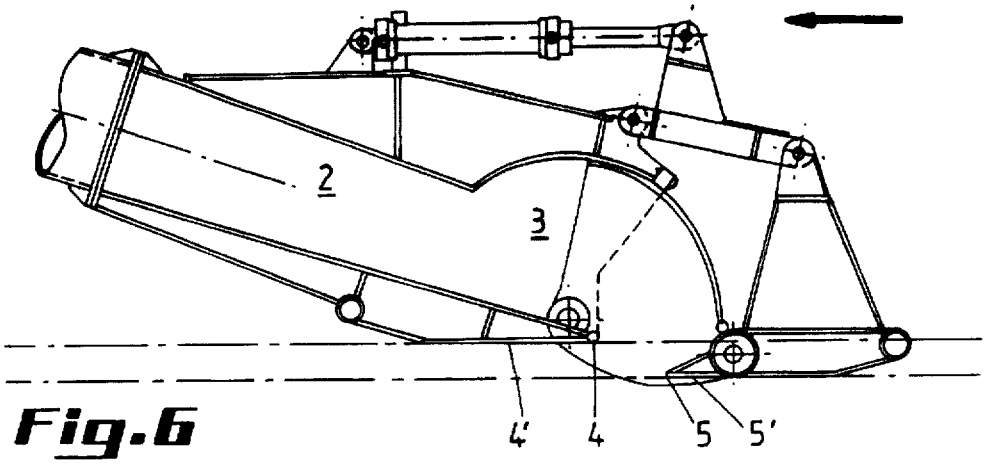
Figure 7:
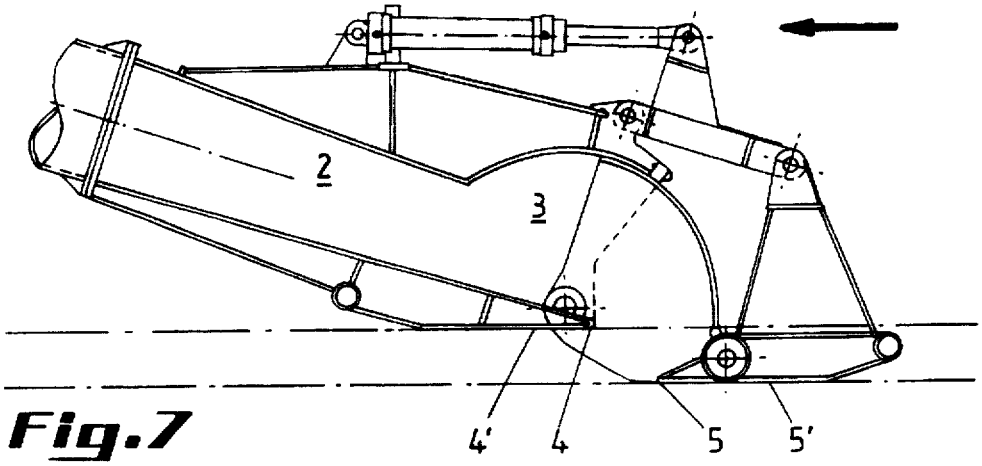
Figure 8:
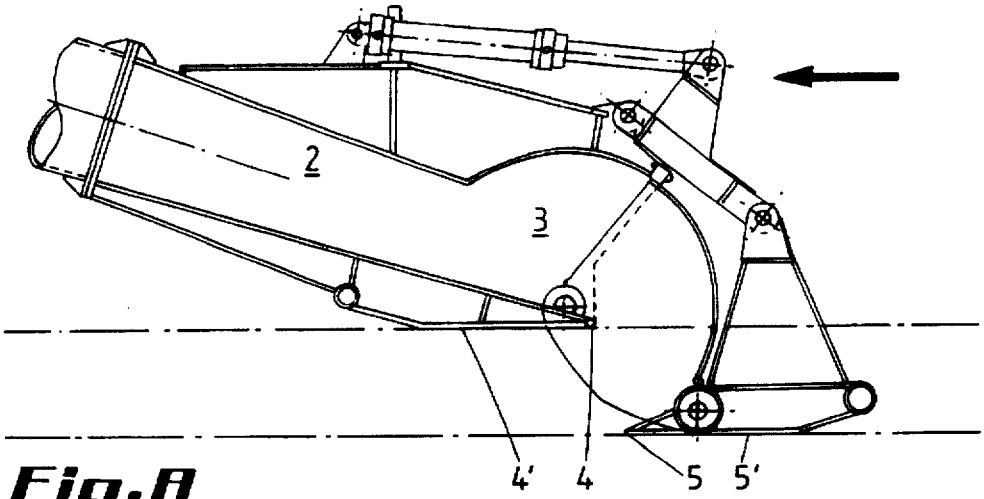

When retracting the hydraulic jack 19 completely, the second scraper 5 is going to position itself in its highest position as shown in FIG. 5. FIGS. 1, 3 and 4 relate to three different positions wherein the second scraper is each time situated above the first scraper and this more particularly on different levels, so that the direction wherein the dredge head is moved is always indicated by the arrow shown in each of the intended figures.

FIGS. 2, 6, 7 and 8 show on the other hand the hydraulic jack 19 in its entirely "extended position". The direction of dredging, still according to these figures, is indicated in each figure by an arrow. The second scraper 5 is always situated below the first scraper 4, but this each time at a different depth.

It has to be noted that for each dredge position, the second scraper 5 positions itself horizontally with respect to the first scraper 4 which is not movable with respect to the suction tube. The thickness of the sludge layer to be dredged can always be determined accurately.

Figure 2:
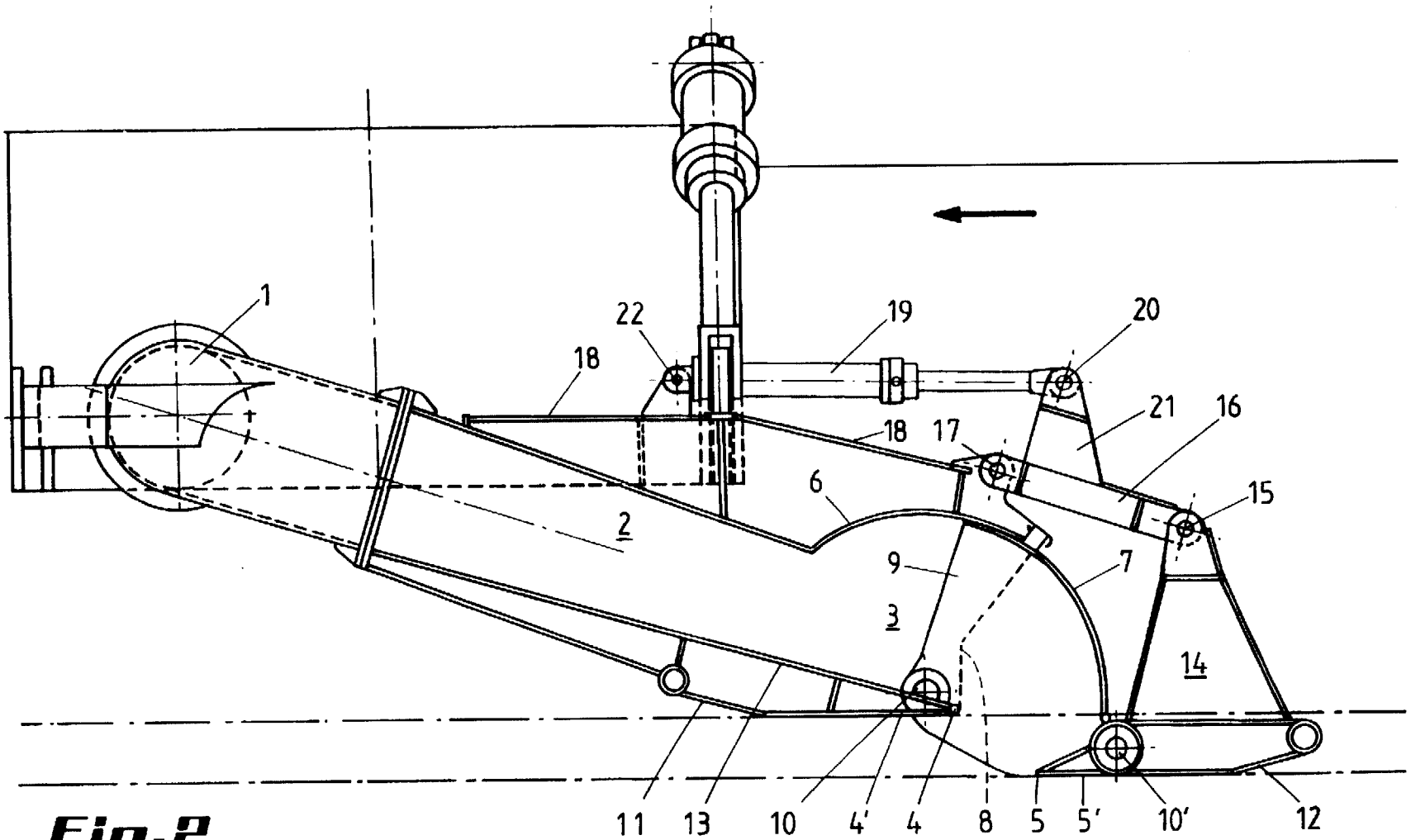
Figure 9:
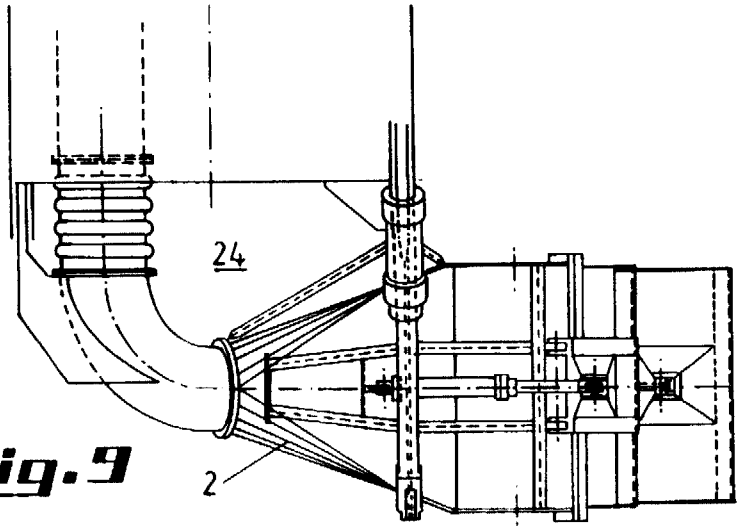
FIG. 9 is a schematic top view of the dredge head according to the invention.
Figure 11:
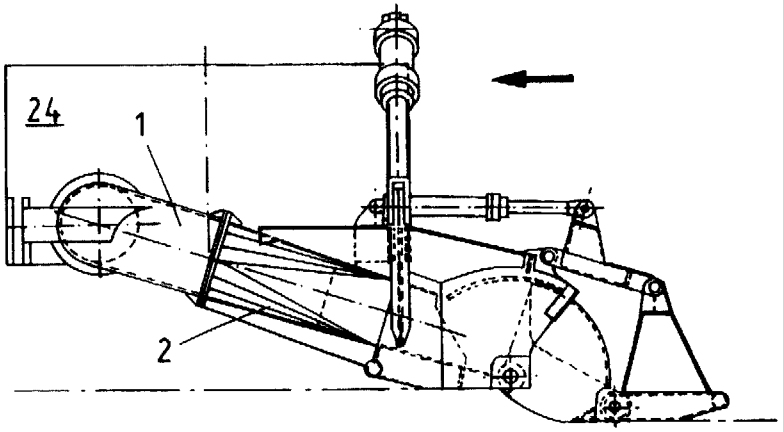
FIG. 11 is a schematic side view of the dredge head according to the invention.
Figure 10:
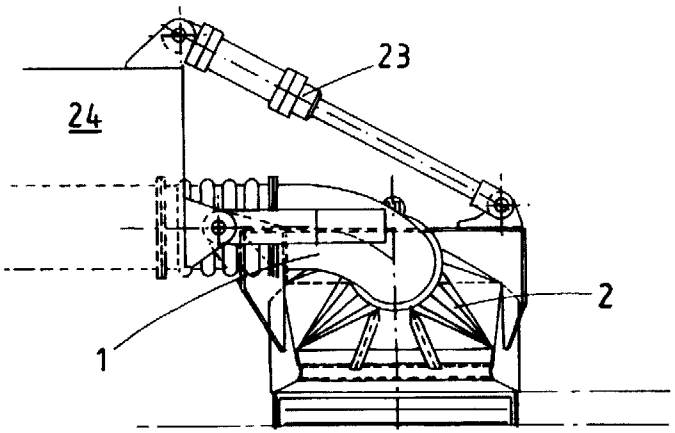
FIG. 10 is a schematic front view of the dredge head according to the invention, on the side of the suction tube.

The horizontal position of the dredge head, and therefore of the scrapers, can be ensured at every moment by making use of a second jack 23 which is fitted with one extremity onto the ladder 24 and with its other extremity it is hingedly connected to the actual dredge head. FIGS. 1 and 2, but especially FIGS. 9 and 10, show clearly how this second jack 23 is positioned.

Thanks to the structure of the dredge head according to the invention, well determined sludge thicknesses can be dredged therefore continuously without having to be afraid of disadvantageously stirring up diluted sludge in the water.

When dredging in both dredging directions shown in the figures, the sludge layer will arrive in the dredge head without being broken up first. The sludge material will thus only be broken up in the dredge head.

With respect to the aimed objective of the invention, namely dredging sludge in an ecological way, the following points have still to be underlined.

By keeping the width of the dredge head restricted, the transport of the dredged materials to the suction tube is simplified and an even flow rate distribution can be expected over the entire width of the dredge head.

By the swinging movements of the suction head according to the invention, the sludge is urged into the opening of the dredge head whilst out of the suction opening the sludge remains motionless and is not stirred. The important aspect of concentration control in the suction head is solved thanks to the following measures:

a) The suction head is sealed on all sides by the just described closed construction;

b) The water supply, via the overlap next to the cut and transported dredged material, remains reduced since the material is pushed up in the dredge head in the direction of the suction tube "overlap" referring to the zone which has already been dredged when cutting a new slice;

c) An additional water supply is possible, at an adjustable flow rate, through nozzles at the bottom of the conical component. This water supply permits to control the amount of water in the dredge head. The water is pumped by an external pump to the nozzles. These nozzles are placed in such a manner that more rigid pieces of material, which may possibly be present, are broken up; These nozzles are situated in the bottom plate of the conical space.

d) The flat plates behind the non-scraping scraper are positioned to cover the material to be dredged. In this way, the water supply to the head is reduced. By adjusting the height of this flat plate behind the non-scraping scraper, the water supply to the head becomes also adjustable here;

e) By controlling the suction pump on the suction tube and the swinging speed, only the pushed up sludge is pumped and this with a minimum of water, which is in all respects advantageous for the collecting and dumping problems downstream the dredger.

The invention is not limited to the hereinabove described embodiment and modifications could be applied thereto in as far as they fall within the scope of the claims annexed hereto.

I claim:

1. A dredge head for dredging sludge by a trailing and pushing motion defining a trailing and pushing direction, the dredge head being configured to be fitted on a ladder of a stationary dredger, the ladder being movable in the trailing and pushing direction for moving the dredge head, the dredge head comprising:

a component defining a passageway having a longitudinal axis in the trailing and pushing direction, the component being configured to be connected to a suction tube at a rear extremity thereof;

a first scraper and a second scraper both disposed at a front extremity of the component and facing one another, the first scraper and the second scraper further having respective cutting edges extending transversely to the longitudinal axis of the passageway and defining an elongated opening therebetween, the first scraper being fixed with respect to the component and the second scraper being configured to have an adjustable height with respect to the first scraper; and a visor connected to the second scraper and being movable with respect to the component for effecting a height adjustment of the second scraper with respect to the first scraper.

2. The dredge head according to claim 1, wherein:

the component includes a fixed arcuate plate at the front extremity thereof;

the visor includes:

a rotatable arcuate plate telescopingly engaging the fixed arcuate plate and having a radius smaller than a radius of the fixed arcuate plate; and side plates connected at respective sides of the rotatable arcuate plate, the visor thereby being bounded at a top region thereof by the rotatable arcuate plate and at side regions thereof by the side plates; and the dredge head further includes means for rotating the visor and the second scraper connected thereto about a horizontal first hinge axis for effecting a height adjustment of the second scraper with respect to the first scraper.

3. The dredge head according to claim 2, wherein:

the visor is hingedly connected to the second scraper at a second hinge axis; and the means for rotating the visor comprises:

a plate connected to the second scraper;

a rotatable arm hingedly connected to the plate at a third hinge axis and hingedly connected to the component at a fourth hinge axis;

a hydraulic jack connected to the rotatable arm;

points corresponding to respective intersections of the first hinge axis, the second hinge axis, the third hinge axis and the fourth hinge axis with a plane perpendicular thereto coincide with four corners of a deformable parallelogram.

4. The dredge head according to claim 3, wherein the hydraulic jack is configured to have a stroke for rotating the rotatable arm between a first extreme position corresponding to an extreme position of the second scraper above the first scraper, and a second extreme position corresponding to an extreme position of the second scraper below the first scraper for effecting a dredging of sludge layers having different thicknesses by a stepless adjustment of the scrapers.

5. The dredge head according to claim 3, wherein the hydraulic jack is a first hydraulic jack, the dredge head further comprising a second hydraulic jack adapted to be hingedly connected at one end thereof to the ladder and hingedly connected at another end thereof to the component, the second hydraulic jack being configured to keep the scrapers in a horizontal position.

6. The dredge head according to claim 1, further comprising nozzles disposed at a bottom region of the passageway for injecting water therein.

* * * * *